US010669000B2

(12) United States Patent
Mahmoudian et al.

(10) Patent No.: US 10,669,000 B2
(45) Date of Patent: Jun. 2, 2020

(54) MOBILE UNDERWATER DOCKING SYSTEM FOR AN UNDERWATER VEHICLE

(71) Applicant: The Government of the United States of America, Arlington, VA (US)

(72) Inventors: Nina Mahmoudian, Houghton, MI (US); Brian Page, Houghton, MI (US)

(73) Assignee: The Governement of the United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/031,294

(22) Filed: Jul. 10, 2018

(65) Prior Publication Data

US 2019/0016425 A1 Jan. 17, 2019

Related U.S. Application Data

(60) Provisional application No. 62/531,302, filed on Jul. 11, 2017.

(51) Int. Cl.
*B63G 8/41* (2006.01)
*B63G 8/00* (2006.01)
(Continued)

(52) U.S. Cl.
CPC ..... *B63G 8/001* (2013.01); *B63C 11/52* (2013.01); *B63G 8/22* (2013.01); *B63G 8/42* (2013.01);
(Continued)

(58) Field of Classification Search
CPC ..... B63G 8/001; B63G 2008/004; B63G 2008/008; B63G 2008/42; B63G 8/22; B63G 8/42; B63B 35/00; B63B 35/40
(Continued)

(56) References Cited

U.S. PATENT DOCUMENTS 8,109,223 B2 * 2/2012 Jamieson ..... B63G 8/001 114/312
10,183,732 B2 * 1/2019 Celikkol ..... G01C 21/20
(Continued)

OTHER PUBLICATIONS

Page B., Master Thesis, Design of a Mobile Underwater Charging System, Nov. 23, 2017, USA.
(Continued)

*Primary Examiner* — Daniel V Venne
(74) *Attorney, Agent, or Firm* — The Office of Naval Research; Barry Edelberg; Michael Badagliacca

(57) ABSTRACT

A docking system has flat funnel and a slotted ramp at the end of the flat funnel. The ramp has a plurality of inclined planes, each on a respective side of the slot. A docking adapter, fitted over an underwater vehicle, includes a guide plane and a mask. The funnel guides the guide plane to the top of the ramp during docking/charging of the underwater vehicle. Another aspect of the invention is a highly maneuverable glider including a forwardly mounted buoyancy module followed, in order, by a pitch module, a processing module, and a roll module, mounted concentrically with respect to each other. The glider may be attached to any docking system. When used in conjunction with the docking system of the present invention, the glider may be attached to either the flat funnel or the docking adapter of the docking system of the present invention.

1 Claim, 2 Drawing Sheets

(51) Int. Cl.
*B63C 11/52* (2006.01)
*B63G 8/22* (2006.01)
*B63G 8/42* (2006.01)

(52) U.S. Cl.
CPC .. *B63G 2008/004* (2013.01); *B63G 2008/008* (2013.01)

(58) Field of Classification Search
USPC ..... 114/256, 263, 312, 313, 322
See application file for complete search history.

(56) References Cited

U.S. PATENT DOCUMENTS

2009/0095209 A1* 4/2009 Jamieson ..... B63G 8/001 114/312
2016/0334793 A1* 11/2016 Celikkol ..... G01C 21/20

OTHER PUBLICATIONS

Page B., Naglak J., Kase C., Mahmoudian N., Collapsible Underwater Docking Station Design and Evaluation, MTS/ IEEE Ocean's 18, Charleston, SC, Oct. 21-25, 2018.
Ziaeefard S., Effective Turning Motion Control of Internally Actuated Autonomous Underwater Vehicles, Journal of Intelligent & Robotic Systems, Springer, 2017.
Page B., Highly Maneuverable Low-Cost Autonomous Underwater Glider: Design and Development, IEEE Robotics and Automation Letters (RA-L), vol. 2, No. 1, pp. 344-349, 2017.
Ziaeefard S., A Novel Roll Mechanism to Increase Maneuverability of Autonomous Underwater Vehicles in Shallow Water, MTS/ IEEEOcean's 16, Monterey, CA, Sep. 19-23, 2016.
Aramizo G., A Multi-level Motion Controller for Low-cost AUVs, IEEE International Conference on Robotics and Automation (ICRA), Seattle, WA, May 26-30, 2015.

* cited by examiner

MOBILE UNDERWATER DOCKING SYSTEM FOR AN UNDERWATER VEHICLE

CROSS-REFERENCE

This Application claims the benefit of priority under 35 U.S.C. 119 based on provisional application No. 62/531,302 filed on Jul. 11, 2017. The Provisional Application and all references cited herein are hereby incorporated by reference into the present disclosure in their entirety.

TECHNICAL FIELD

The embodiments relate to mobile underwater docking systems, as well as autonomous underwater vehicles.

BACKGROUND

Autonomous Underwater Vehicles (AUVs) have seen rapidly expanding usage over the past decade with advances in computation, miniaturization, sensors, and energy storage. Modern AUVs are able to explore the deepest depths of the world's oceans and collect a wide assortment of useful information for commercial, military, and scientific missions. These AUVs are however limited in endurance due to the restricted energy storage capacities of current battery technology. With these limitations, typical AUV endurance is approximately one day with a manual retrieval and recharging process required between missions. The manual retrieval and recharging process necessitates a manned surface vessel to support the AUV, dramatically increasing costs. In open ocean, manned surface vessel costs are in excess of $30,000 USD/day. Despite the large costs, extended AUV missions do occur such as mine detection, Arctic studies and marine geoscience.

One proposed solution to the endurance limitation of AUVs is automated underwater charging stations. These charging stations can be equipped with sources of power either through renewables (solar, wind, wave) or shore power, meaning that they can support charging AUVs indefinitely. Using existing technology, some AUVs are able to operate for extended periods away from manned surface vessels. These existing stations however are limited in their adaptability to other platforms, are costly to install, and are unable to be modified for mobile applications. Additionally, the infrastructure to support persistence is fixed which is not suitable for transient or expansive missions.

Docking stations for autonomous underwater vehicles traditionally belong to one of two types: a large cone-shaped funnel or a pole. By far the most common docking technique is the cone-shaped funnel. In this style of docking station, a large funnel is installed on either the seafloor or any other large system such as on a much larger AUV. The docking procedure for funnel designs involves the AUV homing into the funnel and being guided in by bouncing off of and sliding along the funnel face. Once inside of the funnel, the AUV is latched and power transfer is begun. To undock, the AUV uses reverse thrust until a safe distance away before resuming the mission. Funnel based designs have an excellent capture envelope due to the nature of the funnel shape. They are, however, bulky systems to install and are not adaptable to support multiple types of AUVs.

Pole type docking systems involve a fixed vertical pole with a flat V-shaped latching mechanism on the nose of the AUV. Once latched, the AUV is pushed into the docked position through motorized carriages on the docking station. Pole-based designs enable a large vertical capture area with a relatively small horizontal capture area. Pole docks have historically had problems with homing and maintaining the necessary vertical attitude.

More novel docking solutions have been experimented with including grappling type, stinger and puck, hook, and vertical cones. All of these various solutions each have unique benefits and drawbacks. For example, large funnel shaped docks have a large capture envelope however, the excessive size is a drawback. The small size of the grappling type is desirable, but the capture envelope is very small. An additional consideration in the marine environment (as compared to docking of aerial or space vehicles) is biofouling.

SUMMARY

This summary is intended to introduce, in simplified form, a selection of concepts that are further described in the Detailed Description. This summary is not intended to identify key or essential features of the claimed subject matter, nor is it intended to be used as an aid in determining the scope of the claimed subject matter. Instead, it is merely presented as a brief overview of the subject matter described and claimed herein.

The embodiments include a system including a docking station, including a flat funnel, and a ramp at a narrow end of the flat funnel and defining a slot and comprising a plurality of inclined planes, each on a respective side of the slot; and a docking adapter, fitted over an underwater vehicle, including a guide plane, and a mast, the flat funnel guiding the mast to the slot of the ramp, and the inclined planes of the ramp guiding the guide plane to a top of the ramp during a docking operation.

The embodiments further include an autonomous underwater vehicle including a hull having mounted therein a rail, said rail having mounted thereon, a buoyancy module mounted forward of the center of gravity of said vehicle, said buoyancy module comprising a ballast tank of variable volume and a pump, located behind said ballast tank, that adds and removes water from said ballast tank, thereby changing the buoyancy of said vehicle; a pitch module located behind said buoyancy module, said pitch module comprising a mass and an actuator to drive said mass forward and backward with respect to said rail; and a roll module located behind said pitch module, said roll module comprising a servomotor, mounted to said rail, said roll module controlling said vehicle's roll angle and yaw by action of said servomotor; a processing module, located between said pitch module and said roll module and being in communication with said roll, pitch, and buoyancy modules, that controls functioning of said roll, pitch, and buoyancy modules; said roll, buoyancy, and pitch modules being mounted concentrically with respect to each other.

DETAILED DESCRIPTION

The aspects and features of the present invention summarized above can be embodied in various forms. The following description shows, by way of illustration, combinations and configurations in which the aspects and features can be put into practice. It is understood that the described aspects, features, and/or embodiments are merely examples, and that one skilled in the art may utilize other aspects, features, and/or embodiments or make structural and functional modifications without departing from the scope of the present disclosure.

Figure 1:
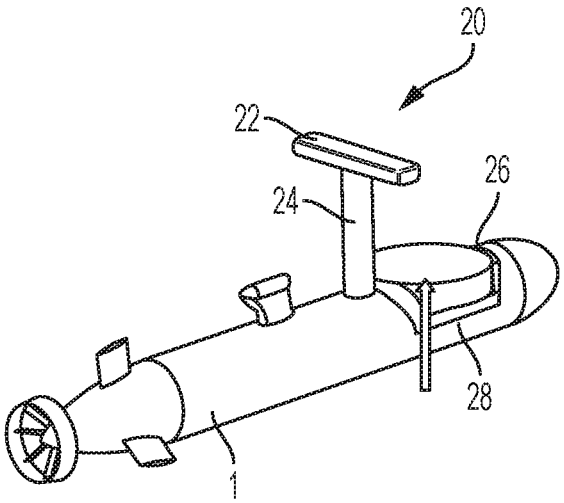
FIG. 1 is a perspective view of a docking adapter in accordance with a described embodiment.

FIG. 1 is a perspective view of a docking adapter 20 that can be fitted on an Autonomous Underwater Vehicle 1. The docking adapter 20 includes guide planes 22, mast 24, latching magnet 26, wireless power module 28, and magnetic coupling (not shown). The docking adapter 20 may be a drop-in replacement for the original antenna mast on the UAV 1. The adapter 20 may be mounted on different diameter vehicles though custom-designed bumpers.

Figure 2:
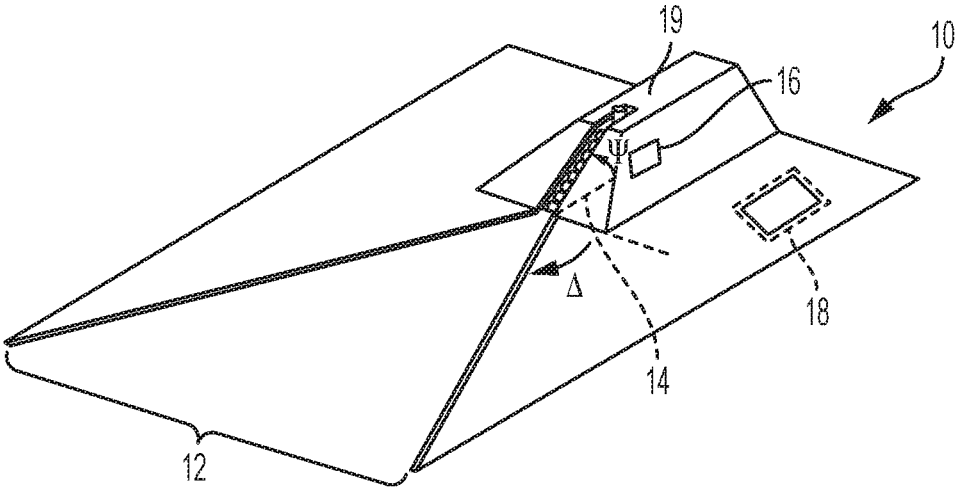
FIG. 2 is a perspective view of a docking station in accordance with a described embodiment.

FIG. 2 is a perspective view of a docking station 10. The docking station 10 may have a rigid frame design and includes a funnel 12, which may have a flat shape, is mounted at a sweep angle (Λ) and to guide the AUV 1 into the docking station 10 along the horizontal plane. The docking station 10 further includes a ramp 14 (mounted at angle Ψ), which pulls the AUV 1 up into a dock 19 after it has been guided toward the dock by the ramp 14. The docking station 10 still further includes a switchable magnet 16 to latch the AUV into the docking station 10 once the AUV 1 is in the dock. Power and data are transferred wirelessly through an inductive power module 18.

The mast 24 slides along the funnel 12 to bring the vehicle into the dock 19. Once in the dock 19, the guide planes 22 slide up the ramp 14 to bring the vehicle up into the docking station 10. The mast 24 can serve a dual purpose as antennas (for example, Iridium, GPS, WiFi) can be installed. The adapter may be a drop-in replacement for a traditional AUV antenna mast. It contains the required power and data transfer modules as well as the docking mechanisms and can be scaled to a variety of AUV classes. Presented here is the docking adapter for a Bluefin SandShark. The design can be attached to other torpedo shaped AUVs with minimal modification to the AUV.

The docking station design 10 may have no exposed moving parts to reduce problems caused due to biofouling. The docking solution 10 has large capture area, compact size, is adaptable to a wide range of vehicle sizes and is able to be installed in a wide variety of situations.

The embodiments of the docking station are adaptable, small scale, long-duration underwater infrastructure as compared to related designs. Furthermore, the docking station may feature no exposed moving parts, enable a large capture envelope, and has an acceptable maximum impact force during docking. Still further, the design is small and lightweight resulting in rapid installation and low-cost operation. Also, the embodiments of the adapter are adaptable to nearly any AUV. The docking adapter may be the only component that contacts the AUV and can be customized to different hulls quickly and at low cost.

Figure 3:
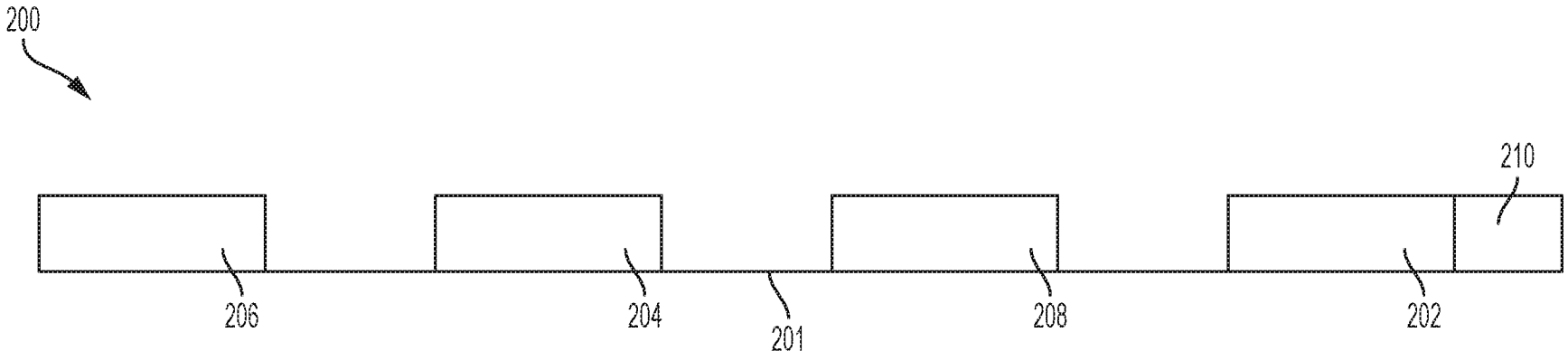
FIG. 3 is a block cross-sectional view of a glider in accordance with a described embodiment.

FIG. 3 is a block cross-sectional view of a glider 200 according to the present invention that has unique and favorable handling characteristics and can be fitted with the docking station 10 according to the present invention so as to function as mobile charging station or as an autonomous vehicle that can be charged by any known method or system, including by a charging station according to the present invention.

The present glider design is largely based on lessons learned during the development of the original Research Oriented Underwater Glider for Hands-on Investigative Engineering (ROUGHIE). The original ROUGHIE design, ROUGHIE1, is described in S. Ziaeefard, B. Page, A. Pinar, and N. Mahmoudian, "A novel roll mechanism to increase maneuverability of autonomous underwater vehicles in shallow water," in OCEANS 2016 MTS/IEEE Monterey, September 2016; B. R. Page, S. Ziaeefard, A. J. Pinar, and N. Mahmoudian, "Highly maneuverable low-cost underwater glider: Design and development," IEEE Robotics and Automation Letters, vol. PP, no. 99, pp. 1-1, 2016; G. A. Ribeiro, A. Pinar, E. Wilkening, S. Ziaeefard, and N. Mahmoudian, "A multi-level motion controller for low-cost underwater gliders," in 2015 IEEE International Conference on Robotics and Automation (ICRA), May 2015, pp. 1131-1136; and B. Mitchell, E. Wilkening, and N. Mahmoudian, "Low cost underwater gliders for littoral marine research," in 2013 American Control Conference, June 2013, pp. 1412-1417, all of which papers are incorporated herein by reference.

The glider of the present invention, similar to the original ROUGHIE, is a small autonomous underwater glider capable of moderate endurance deployments in relatively shallow waters. Mechanically, as shown in FIG. 3 the present glider 200, which is mounted within a torpedo-shaped hull (not shown) is broken into four different modules and major components. The roll module 202 controls the vehicle roll angle to indirectly actuate vehicle yaw. The pitch module 204 shifts the vehicles center of gravity forward and backward to control small pitching motions during glides. The buoyancy module 206 utilizes a ballast tank to control vehicle mass and drive motion in the dive plane. The processing module contains 208 the processing stack that performs all control calculations. Optional coupling/recharging module 210 may be attached at the back of glider 200. Coupling/recharging module 210 can be of any design, and can be, for example, a docking adapter according to the present invention or may be designed to dock with and permit recharging of a system batter of glider 200 by docking with a docking adapter according to the present invention.

The buoyancy module 206 remains largely unchanged from that of the original ROUGHIE. For example, as may be preferable, the increase the pressure rating of the plumbing equipment has been increased. The order of the ballast tank and the pumping equipment has also been switched from that of the original ROUGIE. The ballast tank is now located at the extreme front of the glider to maximize the pitching moment caused by pumping.

In one embodiment of a glider according to the present invention, the pitch module 204 is a reinforced version of the pitch module of the original ROUGHIE design. In the glider of the present invention, the pitch module is behind, and typically immediately behind, the buoyancy module. This module comprises a mass, which can be the system battery, and a custom linear actuator to drive the mass forward and backward in the vehicle to finely control pitch. The mass typically weighs about 2.2 kg. It is therefore convenient, in some embodiments, for the mass to be 25.9V, 12.6 Ah system battery that weighs 2.2 kg. For at least one embodiment, this mass is driven through a range of about 8.5 cm to finely adjust pitch angle. Sensing of the pitch mass position can be provided by a draw wire sensor. Sliding motion can still be achieved by using miniature guide rails, but two guide rails may be used instead of one to help to further reduce friction that the linear mass experiences during motion. Total travel is also upgraded to about 150 mm allowing for a degree of automatic trimming to be implemented. One upgrade from the original ROUGIE is the ability to upgrade to a dual motor configuration. Dual motors will enable doubling of the pitch mass speed for greater control accuracy.

The electrical system of the gilder can be built around central processing unit in processing module 208, such as a BeagleBone Green. The BeagleBone is a single board Linux microcomputer that uses an 1 GHz ARM Cortex-AS processor. Electronics interfacing can be performed, for example, by a custom printed circuit board mounted on top of the Linux computer.

The processing module 208 can use a central processing unit, such as a BeagleBone Green running Linux. The BeagleBone with Linux is capable of supporting MATLAB for path planning operation and Python for low level hardware interaction. The 1 GHz processor ensures that low level interfacing will run unhindered while in operation.

The roll module 202 of glider 200 is mounted to the hull. In one arrangement mounting of the roll module to the hull is via a support made of a lightweight metal such as aluminum, that clamps to the hull and has two interfacing holes for plates made of a lightweight metal such as aluminum. These plates rigidly mount servo blocks that rigidly mount the servo concentrically within the hull. The servo block eliminates the need for any additional support and simplifies the process of attaching the rail to the servo. Positioning the roll module at the back of the glider helps to support the goal of moving the ballast tank as far forward as possible.

Multiple sensors can be used to detect the current state of the vehicle. The vehicle state sensors are the minimum sensor capabilities required for basic dead reckoning navigation. Typical sensors include draw wire sensors, a pressure sensor, and an Attitude and Heading Reference System (AHRS).

Position sensors, such as two Micro-Epsilon MK30 draw wire sensors, can be used to detect the position of the pitch mass and ballast piston. Detection of the pitch mass location can be used to establish software limits on pitch mass location, set feedforward locations, and also calculate the pitch mass location in the glider point mass model. Ballast piston location allows the glider to calculate its net buoyancy which can also be used in the glider point mass model. Both draw wire sensors can operate on 5V and output an analog signal between 0V and 5V depending on sensor position.

A pressure transducer, such as a Honeywell PX3AN1BH010BSAAX pressure transducer, can be mounted in-line with the rest of the pump plumbing. The Honeywell PX3AN1BH010BSAAX sensor supports a pressure rating of 10 bar and outputs an analog signal similar to the draw wire sensors. Pressure readings can be used for depth measurement.

A sensor such as the Vectornav VN-200 Rugged AHRS, can be installed in the glider for inertial navigation, and can pitch, roll, and yaw estimates as well as incorporate GPS positioning when surfaced. Pitch information can be used to control the pitch mass while in feedback mode, roll feedback is similarly performed. GPS positioning can be used when surfaced to perform dead reckoning navigation based on waypoint navigation.

Additional navigation sensors can be equipped on the gilder due to its large payload capacity. Navigational sensors such as a USBL system can support accurate positioning relative to other vessel and AUVs. LBL systems can be installed for operation in more fixed environments. The glider can be equipped with any variety of acoustic modems to enable long range communication between vehicles. Some acoustic modems combine USBL localization into one sensor such as the Evologics S2CR 48/78 Underwater Acoustic USBL System. Location and communication are two critical portions of creating an autonomous underwater network of vehicles. Other navigational sensors that can be equipped on the glider include a Doppler Velocity Log, Sonar, and any variety of traditional AUV sensors.

Scientific sensors can also be equipped on the glider similarly to navigational sensors. Any variety of traditional sensor can be equipped on the glider for measurements. Typical AUV sensors such as the Wetlabs ECO Puck can be equipped to measure chlorophyll and turbidity with relatively low power consumption.

The docking station of the present invention can be used a drop-in replacement for the standard tail-cap and wing of the glider of the present invention. It can carry all required electronics, batteries, and navigational instruments in a self-contained module to simplify implementation on other vehicles. The high maneuverability of the glider, combined with the docking performance of the docking station, improve docking under difficult circumstances.

To ease the docking maneuver, the wing serves dual purpose as bot hydrodynamic surface and funnel for the male coupling. Locking of the two vehicles can be achieved with a permanent switchable magnet that provides appropriate (typically about 650N) of clamping force. The whole system can support docking and power transfer without requiring a single movable part on the outside of the vehicle, thus reducing problems associated with biofouling.

The female coupling design shown in FIGS. 1 and 2 can effectively be an additional hull segment and with custom attachments to enable docking and power transfer. The charging hull segment joins with the rest of the vehicle via a standard piston sealing attachment similarly to all other hull connections. The inside of the segment can include a fixed lithium-ion battery pack, WFS driver electronics, actuators for a switchable magnet, and custom electronics that relay information with the main controller. WFS transmitter coil, switchable magnet, a USBL/acoustic modem (not shown), LED lights, and guide pieces can be attached to the outside of the hull segment. The guide pieces can serve a dual role as both funnel for docking and wings for gliding.

To accelerate adoption by the community, the male coupling system may be designed to require minimal modification of existing AUVs to be integrated into the design. To achieve the minimal modification requirement, the male coupling may be designed to be a bolt-on solution either on the top of the hull or as an additional hull segment, for example, the hull of the glider shown in FIG. 3. As a first demonstration the male coupling has been designed to be a bolt-on solution that mounts on top of the hull near where the mast is located. This recharging package can all the electronics to convert the received power from the coil to DC power. It can be electrically connected without the need for additional hull penetrators as all power and communication is routed through the existing communication mast port. The communication mast itself may require a small amount of modification to make it tall enough to support docking and also to add the wings which pull the two vehicles together during final docking.

What is claimed is:

1. A mobile underwater docking system for an underwater vehicle comprising:

a docking station, comprising:

a flat funnel, and a ramp at a narrow end of the flat funnel and defining a slot and comprising a plurality of inclined planes, each on a respective side of the slot; and a docking adapter, fitted over the underwater vehicle, comprising:

a guide plane, and a mast, the flat funnel guiding the mast to the slot of the ramp, and the inclined planes of the ramp guiding the guide plane to a top of the ramp during a docking operation.

* * * * *